US006945191B2

(12) United States Patent
Collopy

(10) Patent No.: US 6,945,191 B2
(45) Date of Patent: Sep. 20, 2005

(54) GARAGE AND VEHICLE PROTECTOR

(76) Inventor: Charles T. Collopy, 2118 Country Club Cove, Fort Collins, CO (US) 80524

( * ) Notice: Subject to any disclaimer, the term of this patent is extended or adjusted under 35 U.S.C. 154(b) by 400 days.

(21) Appl. No.: 10/260,312

(22) Filed: Sep. 27, 2002

(65) Prior Publication Data

US 2004/0061627 A1 Apr. 1, 2004

(51) Int. Cl.[7] ..... E04H 6/42
(52) U.S. Cl. ..... 116/28 R; 116/24
(58) Field of Search ..... 116/28 R, 28 A, 116/DIG. 24; 33/264; 340/932.2; 49/13, 460

(56) References Cited

U.S. PATENT DOCUMENTS

| | | | | | |
|---|---|---|---|---|---|
| 914,775 | A | * | 3/1909 | Aarons | 40/597 |
| 2,658,967 | A | * | 11/1953 | Matschke, Jr. | 200/61.41 |
| 2,706,462 | A | * | 4/1955 | Evans | 116/28 R |
| 3,180,950 | A | * | 4/1965 | Jacobsen | 200/61.41 |
| 3,395,387 | A | * | 7/1968 | Durant | 340/932.2 |
| 3,438,651 | A | * | 4/1969 | Hertoghe et al. | 116/173 |
| 3,493,925 | A | * | 2/1970 | Brancale | 340/932.2 |
| 3,812,815 | A | * | 5/1974 | Kuenzel | 116/28 R |
| 3,847,497 | A | * | 11/1974 | Guillory, Sr. | 404/10 |
| 4,813,758 | A | | 3/1989 | Sanders | |
| 5,992,343 | A | * | 11/1999 | Drover | 116/28 R |

FOREIGN PATENT DOCUMENTS

| | | | | |
|---|---|---|---|---|
| FR | 2724967 A1 | * | 3/1996 | E04H/6/42 |
| GB | 2293682 A | * | 4/1996 | G08B/21/00 |
| JP | 08112174 A | * | 5/1996 | A47G/1/02 |
| JP | 2000220315 A | * | 8/2000 | E04H/6/42 |

* cited by examiner

*Primary Examiner*—R. Alexander Smith
(74) *Attorney, Agent, or Firm*—Ancel W. Lewis, Jr.

(57) ABSTRACT

Garage and vehicle protector disclosed mounts on a garage and has an indicator positioned inward from the left side of the door opening to guide a driver to correctly align a vehicle laterally when entering or exiting the garage. The protector has an adjustable support that is adjusted such that the automobile mirror just touches the indicator when the vehicle is correctly aligned. One or more fuzzy balls or a feather preferably coated with a flourescent material is used as the indicator. The indicator and support are resilient to flex when contacted and return to the original position when the contact force is removed.

4 Claims, 4 Drawing Sheets

GARAGE AND VEHICLE PROTECTOR

TECHNICAL FIELD

The present invention relates to protectors for garages and vehicles, and more particularly to a protector having an indicator for lateral guidance of a vehicle moving through a garage door.

BACKGROUND ART

There are several known devices that help drivers park a motor vehicle at a selected distance from the back wall of a garage. A simple device of this type is a tennis ball suspended by a string from the garage ceiling at a selected location such that the vehicle is stopped when the tennis ball contacts a selected part, such as the windshield, on the vehicle. Other devices are electronic, using radar or ultrasound sensing, and audio, light or laser indicators, but these devices offer no meaningful lateral protection of the garage and the vehicle.

Due to the limited width of a garage door opening relative to the width of the vehicle, drivers often have difficulty avoiding hitting the garage door sides defining the garage door opening with the vehicle. Such collisions can damage the vehicle and the garage. The devices described above provide little assistance in aligning the vehicle laterally relative to the garage door opening. Sanders, U.S. Pat. No. 4,813,758 discloses a vehicle parking guide using vertically disposed deflectors positioned in longitudinally offset relation and a mirror to provide both lateral and longitude positioning guidance. This is a relatively complex and expensive device. A simple inexpensive device that provides lateral guidance for a vehicle entering a garage is desirable.

DISCLOSURE OF THE INVENTION

A garage and vehicle protector includes a resilient indicator and a resilient support connected to the indicator that mounts advantageously to only the left side of the garage of the garage door opening. A means for mounting connected to the support facilitates mounting the indicator and support so the indicator is positioned a selected distance into the garage door opening. The indicator is positioned such that when the vehicle, preferably the left side mirror, just touches the indicator when entering or exiting the garage, the vehicle is correctly laterally positioned in the garage door opening. The indicator is soft so as to not scratch the vehicle and resilient so as to deflect when contacted by the vehicle and return to the original position when the contact force is removed. A single or multiple fuzzy balls and a feather are examples of suitable indicators. The means for mounting fastens inside or outside the garage and one embodiment fastens to the roller track.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
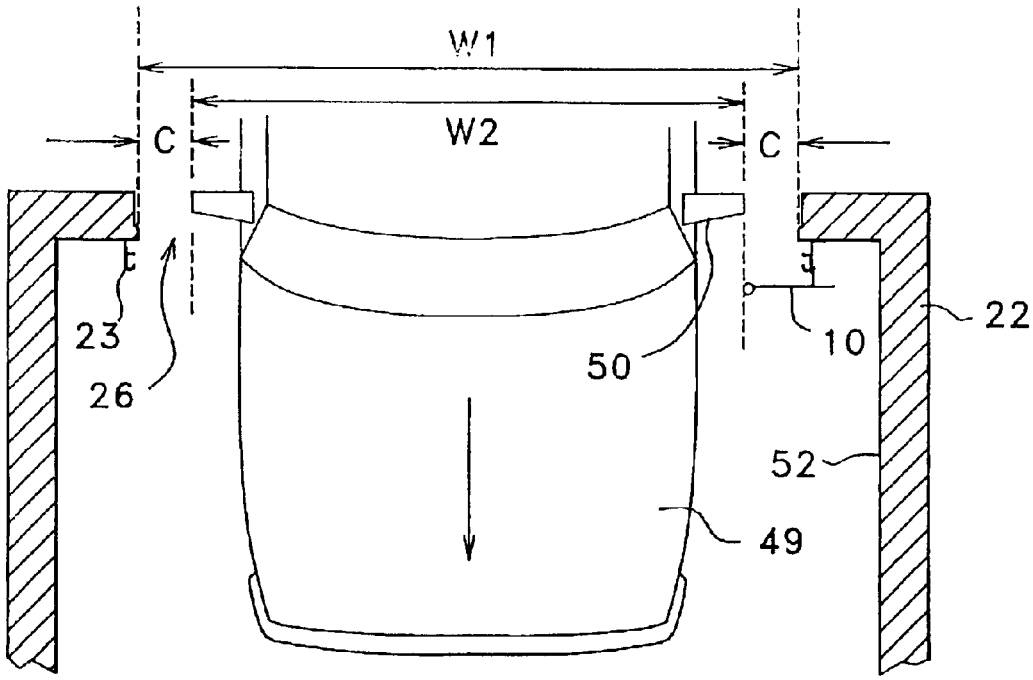
FIG. 1 is a top plan view of a garage door opening showing a vehicle partially inside the garage, embodying features of the present invention mounted on the inside of the garage and garage door.
Figure 2:
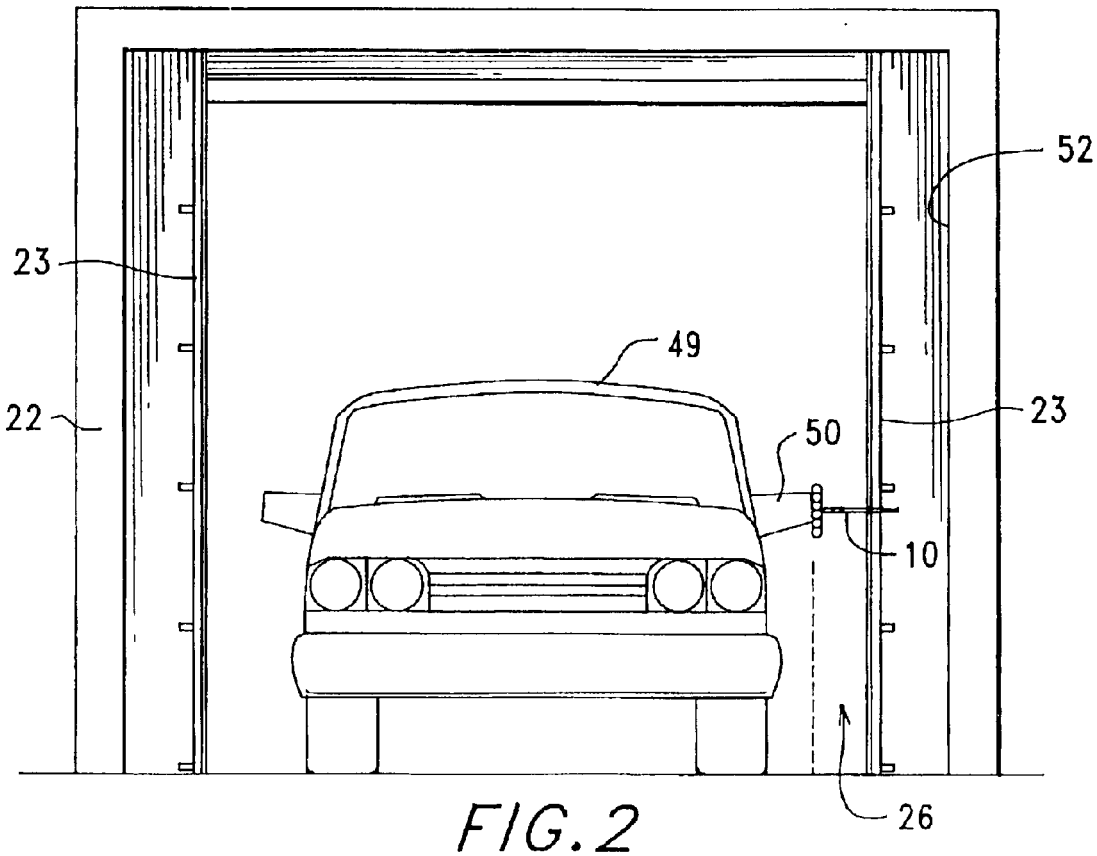
FIG. 2 is a front elevation view of the illustration of FIG. 1 as viewed from inside the garage.
Figure 3A:
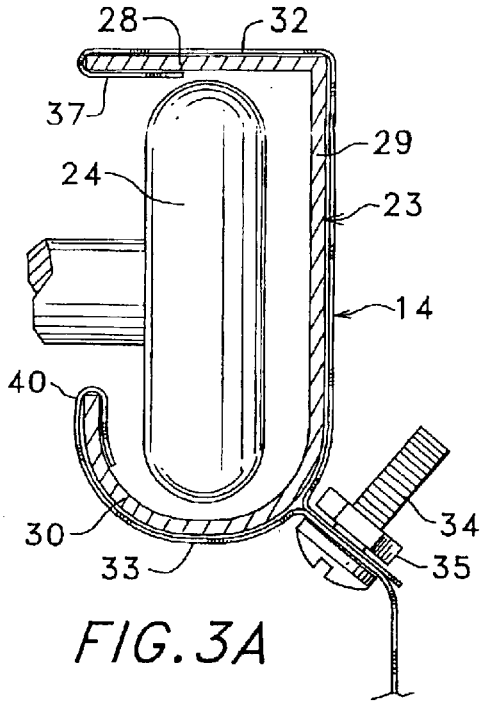
FIG. 3A is an enlarged top plan view of a portion of FIG. 3 showing the protector clamped to the rail.
Figure 3:
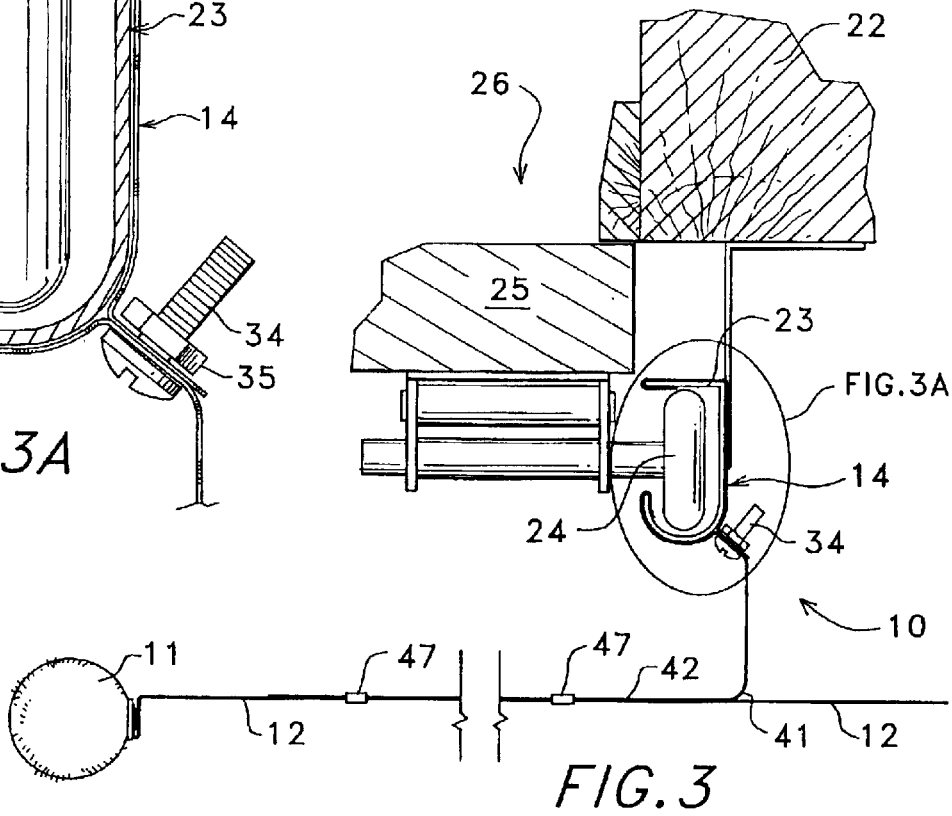
FIG. 3 is an enlarged top plan view of a portion of the left side of the garage door opening of FIG. 1 showing the protector clamped to the rail.
Figure 4:
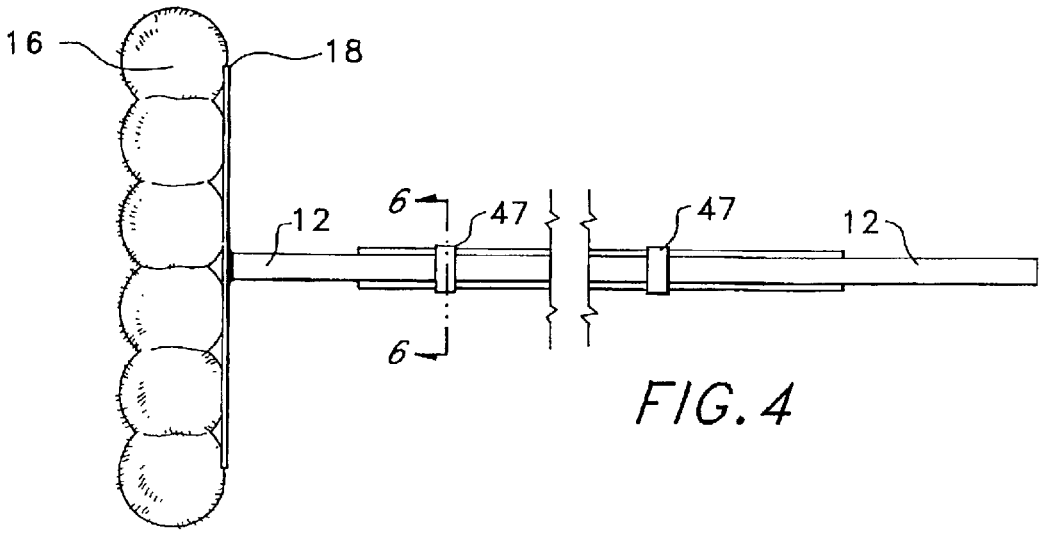
FIG. 4 is a front elevation view of the protector shown in FIG. 3.
Figure 5:
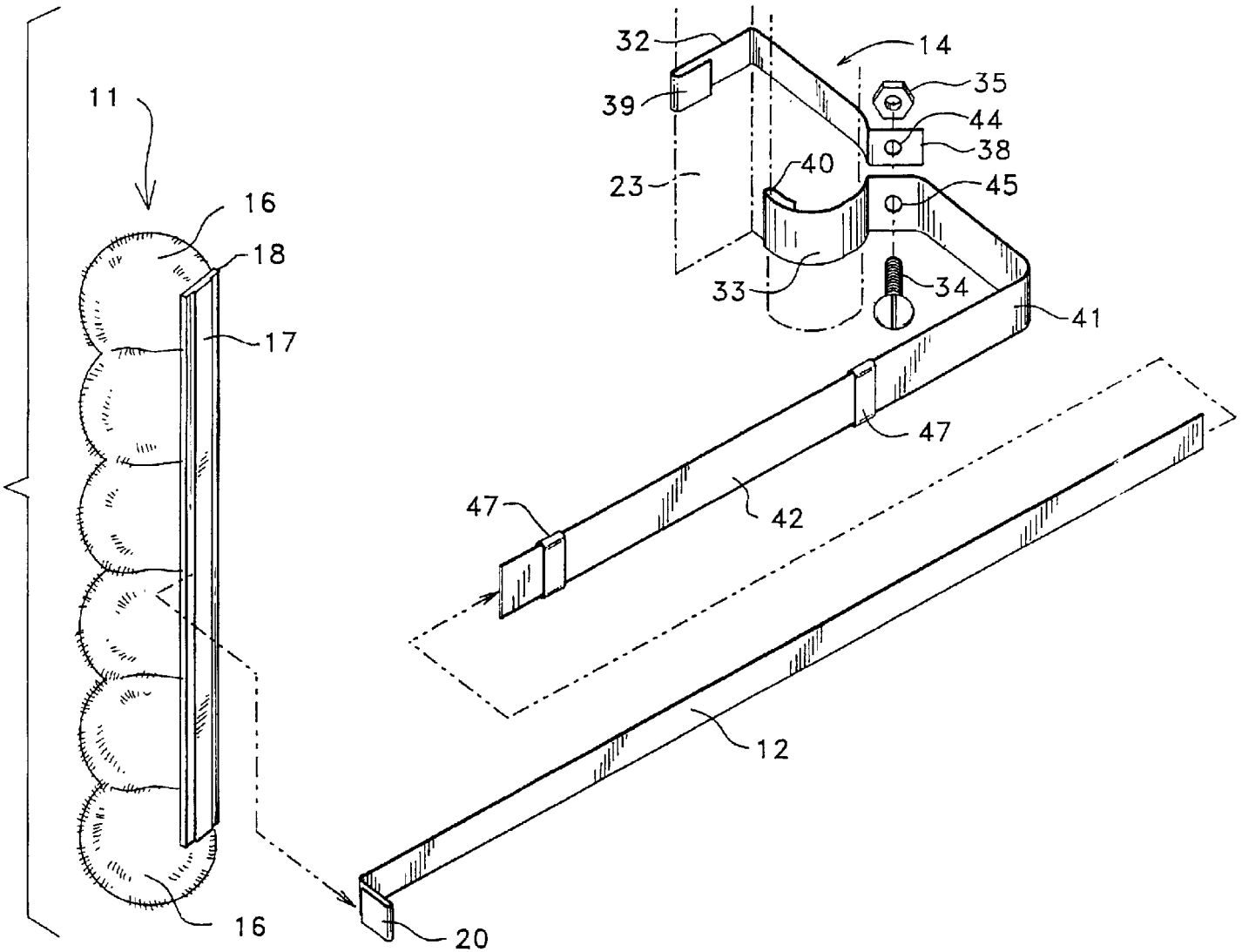
FIG. 5 is an exploded perspective view of FIG. 3.
Figure 6:
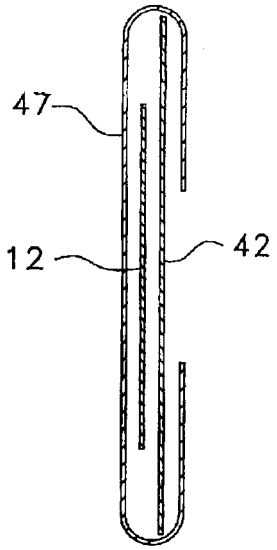
FIG. 6 is a sectional view taken along line 6—6 of FIG. 4.

Referring now to FIGS. 1, 2 and 3, a garage and vehicle protector 10 embodying features of the present invention includes an indicator 11 and a support 12 connected to the indicator 11. A means for mounting 14 is connected to the support 12. The indicator 11 is resilient and has a clearly visible color such as red and an exterior of soft material that will not scratch a vehicle finish. A flourescent coating on indicator 11 to enable it to glow in the dark is desirable. The indicator 11 shown has a plurality of vertically arrayed, soft, fuzzy balls 12 attached to a flat, elongated, substantially rigid indicator strip 17 by double sided, adhesive, foam tape 18 therebetween. Other materials such as foam, fabric or feather are suitable. In the illustrated embodiment, six bright colored, typically red balls 16 are used and are attached to one force of tape 18 by the adhesive with each ball 16 having a diameter in the range of one and one half inches. The indicator strip, in the illustrated embodiment is metal, but other materials such as plastic could be used. This resilient construction enables the indicator to be deflected when contacted by a moving vehicle and return to the original position when the contact force is removed.

Support 12 is mounted to the indicator strip 17 and extends substantially horizontally therefrom. The support 12 shown is a thin, flat, elongated strip of material typically brass or stainless steel, with vertical side surfaces of substantial extent as comprised of the thickness and with a U-shaped end portion 20 that wraps around the indicator strip 17. Due to the horizontally extending vertical orientation, the support 12 shown is vertically rigid to support the indicator 11, and sufficiently elastic or flexible and resilient to bend laterally or horizontally if an object impacts the indicator 11 and returns to the original position when the contact force is removed without harming the vehicle. Other methods of mounting the support 12 to the indicator 11, such as rivets, threaded fasteners or adhesives, are also suitable.

The means for mounting 14 attaches to he support 12, opposite the indicator 11 and mounts on the garage 22. In the illustrated embodiment, the means for mounting 14 mounts on a U-shaped or channel shaped garage door roller track inside the garage and garage door that guides the rollers 24 for the garage door 25 in the garage door opening 26. The track 23 has a front portion 28, an outside portion 29 and a rear portion 30. The means for mounting includes a first clamp portion 32, a second clamp portion 33, a threaded bolt 34 and a threaded nut 35. The first and second clamp portions 32 and 33 are each a thin flat, elongated strip, preferably of a malleable material and preferably brass or stainless steel.

The first clamp portion 32 is formed at one end to wrap around the front portion 28 and the outside portion 29 of the track 23, with a hooked first end 37 that hooks onto the front portion 28 and a spaced striaght second end 38 that extends diagonally, rearwardly and outwardly from the track 23, near the rear portion 30. The second clamp portion 33 has a hooked first end 40 that hooks onto the rear portion 30 of the track. The second clamp portion 33 is formed to wrap around the rear portion 30 to meet the first portion 32 and to extend diagonally, rearwardly and outwardly from the track 23 in a parallel, overlapping configuration with the second end 38 of the first clamp portion 32. The second clamp portion 33 bends at the elbow 21, and extends therefrom inwardly to a spaced, straight second end 42.

Aligned first and second apertures 44 and 45 extend through the first and second clamp portions 32 and 33, respectively, near the second end 38 of the first clamp portion 32. The bolt extends through the first and second apertures 44 and 45, and the nut 35 is threaded into the bolt 34 to clamp the means for mounting 14 onto the track 23. The support 12 is positioned to overlap the second portion 33 of the means for mounting 14, between the elbow and the second end 42 of the second portion, with the indicator 11 located advantageously inside the garage door opening 26. Two spaced clips 47 wrap around the overlapping support 12 and second portion 33 to adjustably secure the support 12 to the means for mounting 14. The support 12 extends beyond elbow a substantial distance to provide a weight counterbalance for the balls.

A preferred procedure for installing the above described protector 10 is as follows:

1. Drive the vehicle into the garage door opening so that the left side mirror is opposite the point of attachment to the roller track. The height of the point of attachment will be the same as the elevation of the left side rear view mirror. The lateral position of the vehicle ideally is centered in the garage door opening. This may be accomplished by first measuring the width W1 of the garage door opening 26 and the width W2 of the vehicle across the mirrors 50. The clearance distance C is calculated as one half the distance between W1 and W2. In practice the clearance distance on the driver's side would be slightly less than the clearance distance on the passenger side.
2. Place the first clamp portion 32 on the rail by hooking the hooked first end 37 over the front portion 28 of the rail and secure by squeezing the end 37 with a pliers.
3. Attach the second clamp portion 33 to the first clamp portion by inserting the ball 34 through the apertures 44 and 45 and threading the nut 35 on ball 35 to a tight position.
4. With strip 17 attached to support 21 and support 21 overlapping second end 42, the strips 17 with balls 16 are moved laterally until the balls touch or is very close to the left side rear view mirror.
5. Squeeze the clips 47 together with a pliers to set the lateral length of support 21 for this installation.

Figure 7:
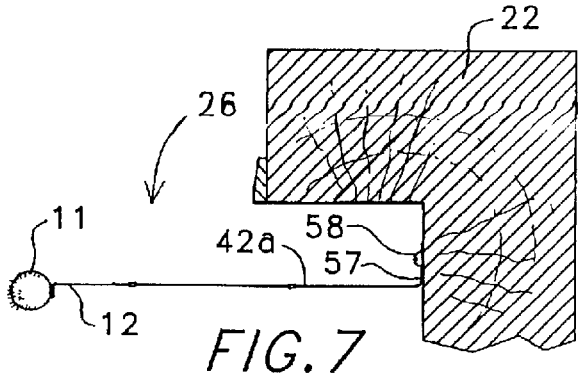
FIG. 7 is a top plan view of the protector of FIG. 1 mounted to the inside wall of the garage.

Referring now to FIG. 7, the protector of FIG. 3 is modified by providing a second clamp portion 42*a*. This terminates in an angle portion 57 through which a screw 58 extends to fasten the protector on the inside wall of the garage instead of to the roller track.

Figure 8:
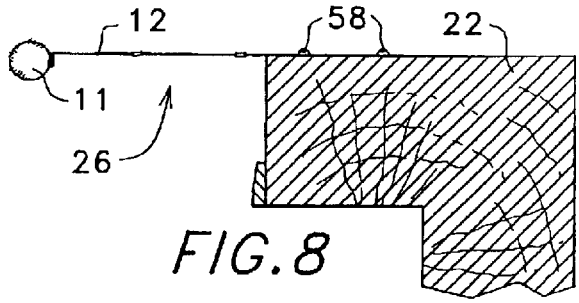
FIG. 8 is a top plan view of the protector of FIG. 1 mounted to the outside wall of the garage.
Figure 9:
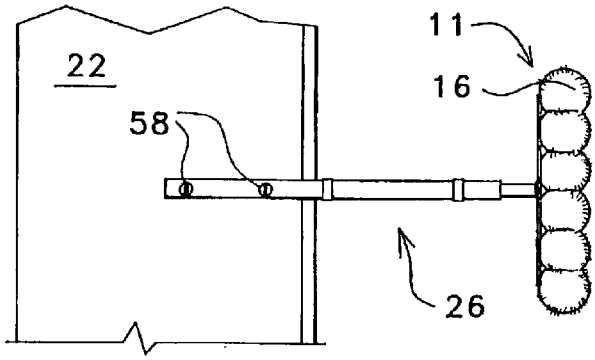
FIG. 9 is a front elevation view of the protector shown in FIG. 8 as viewed from the outside of the garage looking into the garage door opening.

Referring not to FIGS. 8 and 9, a second clamp portion 42*b* is made straight at the end and receives screw 58 to fasten the support 21 on the outside face of the garage at the garage opening. This would be used where there is no track or attachment to the track would interfere with the movement of the roller in the track.

Figure 10:
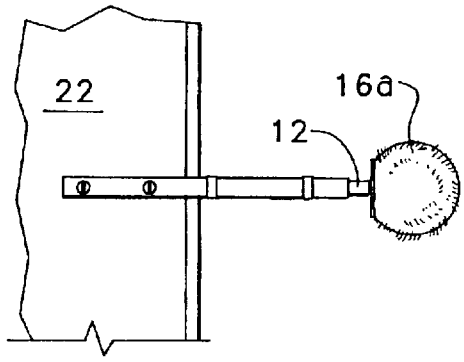
FIG. 10 is a front elevation view of a portion of the protector shown in FIG. 9 using only a single larger ball.

Referring now to FIG. 10 there is shown the use of a single indicator ball 16*a* that is larger in diameter than the previously described balls 16 such as two inches in diameter.

Figure 11:
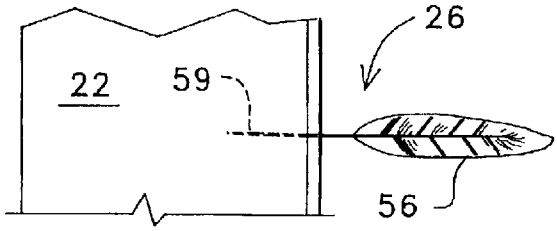
FIG. 11 is an elevation view of an alternative protector using a bird feather.

Referring now to FIG. 11, an alternative indicator and support is provided by a birds feather 56 having the stem thereof extending into a hole 59 in the face of the left side member 22. The adjustment for a particular vehicle would by to cut the end of the feather so that it barely touches the rear view mirror.

Figure 12:
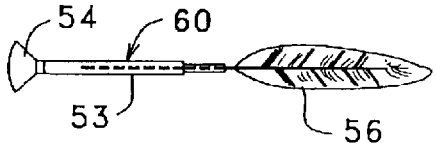
FIG. 12 is an elevation view of a modification of the alternative protector shown in FIG. 11.

A modification of the use of the feather shown in FIG. 12 shows the stem of the feather slidable in a tube 53 having suction cup 54 at one end of the tube that fastens to the garage a set screw 60 would set the length of the feather for contacting the left side rear view mirror.

Although the present invention as been described with a certain degree of particularity, it is understood that the present disclosure has been made by way of example and that changes in details of structure may be made without departing from the spirit thereof.

What is claimed is:

1. A protector in combination with a vehicle and a garage for providing visual side to side guidance of the vehicle having a left side rear view mirror traveling through a garage door opening of the garage having a left side member along a left side of a garage door opening and a U-shaped garage door roller track, comprising:

a resilient indicator having a flat, elongated, vertically extending indicator strip of a material rigid against vertical displacement, double sided tape attached to and extending along said indicator strip, and a plurality of brightly colored, fuzzy balls vertically arrayed along said tape, a substantially horizontally extending, flat, elongated support, with vertical surfaces, having an indicator end portion that wraps around said indicator strip to attach said support to said indicator, and means for mounting including flat, elongated first and second clamp portions, a threaded bolt and a threaded nut, said first clamp portion having a hooked first end that hooks onto said track, said second clamp portion having a hooked first end that hooks onto said track opposite said first end of said first clamp portion, said first and second clamp portions wrapping around said track, meeting, and extending away from said track in an overlapping configuration, said bolt extending through said first and second clamp portions where said first and second clamp portion overlap, and said nut threading onto said bolt to clamp said first and second clamp portions to said track, said second clamp portion having an elbow and a spaced second end with said second clamp portion extending rearwardly and outwardly from said track to said elbow and inwardly from said elbow to said second end, with said support being positioned in an overlapping relationship with said second clamp portion between said elbow and said second end of said second clamp portion, and said support having spaced clips that wrap around said support and said second clamp portion to adjustably secure said support to said means for mounting, to extend said indicator a selected horizontal clearance distance into said garage door opening from said left side member whereby said indicator contacts said left side rear view mirror to guide a driver to correctly laterally align the vehicle in said opening.

2. A protector in combination with a vehicle and a garage having a left side member along a left side of a garage door opening, comprising:

a resilient indicator, a resilient support connected to said indicator and connectable to said left side member and located a selected distance into said garage door opening from said left side member to establish a lateral clearance distance for the vehicle from said left side member to guide a driver to correctly laterally aline the vehicle in said opening wherein said indicator and support and deflected when contacted by a moving vehicle in the garage and return to the original position when the contact force is removed so that contact between the vehicle and garage may be avoided, said means for mounting mounts on a garage door roller track, said means for mounting includes flat, elongated first and second clamp portions, threaded bolt and a threaded nut with said first clamp portion having a hooked first end that hooks onto said track, said second clamp portion having a hooked first end that hooks onto said track opposite said first end of said first clamp portion, said first and second clamp portions wrapping around said track, meeting, and extending away from said track in an overlapping configuration, said bolt extending through said first and second clamp portions where said first and second clamp portion overlap, and said nut threading onto said bolt to clamp said means for mounting to said track.

3. The combination as set forth in claim 2 wherein said second clamp portion has an elbow and a spaced second end with said second clamp portion extending rearwardly and outwardly from said track to said elbow and inwardly from said elbow to said second end.

4. A protector in combination with a vehicle and a garage having a left side member along a left side of a garage door opening, comprising:

a resilient indicator, a resilient support connected to said indicator and connectable to said left side member and located a selected distance into said garage door opening from said left side member to establish a lateral clearance distance for the vehicle from said left side member to guide a driver to correctly laterally aline the vehicle in said opening wherein said indicator and support and deflected when contacted by a moving vehicle in the garage and return to the original position when the contact force is removed so that contact between the vehicle and garage may be avoided, said means form mounting mounts on a garage door roller track, said means for mounting includes flat, elongated first and second clamp portions, threaded bolt and a threaded nut with said first clamp portion having a hooked first end that hooks onto said track, said second clamp portion having a hooked first end that hooks onto said track opposite said first end of said first clamp portion, said first and second clamp portions wrapping around said track, meeting, and extending away from said track in an overlapping configuration, said bolt extending through said first and second clamp portions where said first and second clamp portion overlap, and said nut threading onto said bolt to clamp said means for mounting to said track, said second clamp portion has and elbow and a spaced second end with said second clamp portion extending rearwardly and outwardly from said track to said elbow and inwardly from said elbow to said second end, said support is a flat elongated strip that is positioned in an overlapping relationship with said second clamp portion between said elbow and said second end of said second clamp portion, and said support has spaced clips that wrap around said support and said second clamp portion to adjustably secure said support to said means for mounting.

* * * * *